US007827749B2

(12) United States Patent
Groeke et al.

(10) Patent No.: US 7,827,749 B2
(45) Date of Patent: Nov. 9, 2010

(54) PANEL AND METHOD OF MANUFACTURE

(75) Inventors: Carsten Groeke, Berlin (DE); Martin Prager, Heiligengrabe (DE)

(73) Assignee: Flooring Technologies Ltd., Pieta (MT)

( * ) Notice: Subject to any disclaimer, the term of this patent is extended or adjusted under 35 U.S.C. 154(b) by 716 days.

(21) Appl. No.: 11/615,701

(22) Filed: Dec. 22, 2006

(65) Prior Publication Data

US 2007/0175160 A1 Aug. 2, 2007

(30) Foreign Application Priority Data

Dec. 29, 2005 (DE) ..... 10 2005 063 034

(51) Int. Cl.
*E04B 5/00* (2006.01)
*E04C 2/00* (2006.01)

(52) U.S. Cl. ..... 52/316; 52/796.1; 52/592.1; 52/313; 52/515; 428/192

(58) Field of Classification Search ..... 52/782.1, 52/783.1, 796.1, 589.1, 592.1, 311.1, 313, 52/316, 515, 311.2; 428/192
See application file for complete search history.

(56) References Cited

U.S. PATENT DOCUMENTS

| | | | |
|---|---|---|---|
| 213,740 | A | 4/1879 | Conner |
| 623,562 | A | 4/1899 | Rider |
| 714,987 | A | 12/1902 | Wolfe |
| 753,791 | A | 3/1904 | Fulghum |
| 1,124,228 | A | 1/1915 | Houston |
| 1,407,679 | A | 2/1922 | Ruthrauff |
| 1,454,250 | A | 5/1923 | Parsons |
| 1,468,288 | A | 9/1923 | Een |
| 1,477,813 | A | 12/1923 | Daniels |
| 1,510,924 | A | 10/1924 | Daniels et al. |
| 1,540,128 | A | 6/1925 | Houston |
| 1,575,821 | A | 3/1926 | Daniels |
| 1,602,256 | A | 10/1926 | Sellin |
| 1,602,267 | A | 10/1926 | Karwisch |
| 1,615,096 | A | 1/1927 | Meyers |
| 1,622,103 | A | 3/1927 | Fulton |

(Continued)

FOREIGN PATENT DOCUMENTS

| | | |
|---|---|---|
| AT | 005566 | 8/2002 |

(Continued)

OTHER PUBLICATIONS

Webster Dictionary, p. 862.

(Continued)

*Primary Examiner*—Robert J Canfield
*Assistant Examiner*—Brent W Herring
(74) *Attorney, Agent, or Firm*—Andrew M. Calderon; Roberts Mlotkowski Safran & Cole, P.C.

(57) ABSTRACT

A panel, in particular a floor panel, has a core of a wooden material, in particular MDF or HDF, or a wooden material/plastic mixture. A pattern is arranged on a visible side. The visible side is provided on at least one side edge (I, II) with a chamfer running at an angle α hereto and a length (L). The angle α of at least one of the chamfers varies over the length (L).

15 Claims, 4 Drawing Sheets

U.S. PATENT DOCUMENTS

| | | | | | |
|---|---|---|---|---|---|
| 1,622,104 | A | | 3/1927 | Fulton | |
| 1,637,634 | A | | 8/1927 | Carter | |
| 1,644,710 | A | | 10/1927 | Crooks | |
| 1,660,480 | A | | 2/1928 | Daniels | |
| 1,714,738 | A | | 5/1929 | Smith | |
| 1,718,702 | A | | 6/1929 | Pfiester | |
| 1,734,826 | A | | 11/1929 | Pick | |
| 1,764,331 | A | | 6/1930 | Moratz | |
| 1,776,188 | A | | 9/1930 | Langb'aum | |
| 1,778,069 | A | | 10/1930 | Fetz | |
| 1,779,729 | A | | 10/1930 | Bruce | |
| 1,787,027 | A | | 12/1930 | Wasleff | |
| 1,823,039 | A | | 9/1931 | Gruner | |
| 1,859,667 | A | | 5/1932 | Gruner | |
| 1,898,364 | A | | 2/1933 | Gynn | |
| 1,906,411 | A | | 5/1933 | Potvin | |
| 1,921,164 | A | | 8/1933 | Lewis | |
| 1,929,871 | A | | 10/1933 | Jones | |
| 1,940,377 | A | | 12/1933 | Storm | |
| 1,946,648 | A | | 2/1934 | Taylor | |
| 1,953,306 | A | | 4/1934 | Moratz | |
| 1,986,739 | A | | 1/1935 | Mitte | |
| 1,988,201 | A | | 1/1935 | Hall | |
| 2,023,066 | A | | 12/1935 | Curtis et al. | |
| 2,044,216 | A | | 6/1936 | Klages | |
| 2,065,525 | A | | 12/1936 | Hamilton | |
| 2,123,409 | A | | 7/1938 | Elmendorf | |
| 2,220,606 | A | | 11/1940 | Malarkey et al. | |
| 2,276,071 | A | | 3/1942 | Scull | |
| 2,280,071 | A | | 4/1942 | Hamilton | |
| 2,324,628 | A | | 7/1943 | Kähr | |
| 2,328,051 | A | | 8/1943 | Bull | |
| 2,380,885 | A | * | 7/1945 | Wack | 52/316 |
| 2,398,632 | A | | 4/1946 | Frost et al. | |
| 2,430,200 | A | | 11/1947 | Wilson | |
| 2,437,236 | A | * | 3/1948 | Aas | 114/358 |
| 2,740,167 | A | | 4/1956 | Rowley | |
| 2,894,292 | A | | 7/1959 | Gramelspacker | |
| 3,045,294 | A | | 7/1962 | Livezey, Jr. | |
| 3,100,556 | A | | 8/1963 | De Ridder | |
| 3,125,138 | A | | 3/1964 | Bolenbach | |
| 3,182,769 | A | | 5/1965 | De Ridder | |
| 3,203,149 | A | | 8/1965 | Soddy | |
| 3,204,380 | A | | 9/1965 | Smith et al. | |
| 3,209,800 | A | * | 10/1965 | Leibow | 144/134.1 |
| 3,241,453 | A | * | 3/1966 | Baldwin | 409/180 |
| 3,263,722 | A | | 8/1966 | Ask | |
| 3,267,630 | A | | 8/1966 | Omholt | |
| 3,282,010 | A | | 11/1966 | King, Jr. | |
| 3,310,919 | A | | 3/1967 | Bue et al. | |
| 3,347,048 | A | | 10/1967 | Brown et al. | |
| 3,460,304 | A | | 8/1969 | Braeuninger et al. | |
| 3,481,810 | A | | 12/1969 | Waite | |
| 3,526,420 | A | | 9/1970 | Brancaleone | |
| 3,538,665 | A | | 11/1970 | Gohner | |
| 3,553,919 | A | | 1/1971 | Omholt | |
| 3,555,762 | A | | 1/1971 | Costanzo, Jr. | |
| 3,608,258 | A | | 9/1971 | Spratt | |
| 3,694,983 | A | | 10/1972 | Couquet | |
| 3,714,747 | A | | 2/1973 | Curran | |
| 3,720,027 | A | | 3/1973 | Christensen | |
| 3,731,445 | A | | 5/1973 | Hoffmann et al. | |
| 3,759,007 | A | | 9/1973 | Thiele | |
| 3,760,548 | A | | 9/1973 | Sauer et al. | |
| 3,768,846 | A | | 10/1973 | Hensley et al. | |
| 3,779,294 | A | * | 12/1973 | Gillis | 144/117.3 |
| 3,859,000 | A | | 1/1975 | Webster | |
| 3,878,030 | A | | 4/1975 | Cook | |
| 3,902,293 | A | | 9/1975 | Witt et al. | |
| 3,908,053 | A | | 9/1975 | Hettich | |
| 3,936,551 | A | | 2/1976 | Elmendorf et al. | |
| 3,988,187 | A | | 10/1976 | Witt et al. | |
| 4,006,048 | A | | 2/1977 | Cannady, Jr. et al. | |
| 4,046,180 | A | * | 9/1977 | Marshall et al. | 144/420 |
| 4,090,338 | A | | 5/1978 | Bourgade | |
| 4,091,136 | A | | 5/1978 | O'Brien et al. | |
| 4,099,358 | A | | 7/1978 | Compaan | |
| 4,118,533 | A | | 10/1978 | Hipchen et al. | |
| 4,131,705 | A | | 12/1978 | Kubinsky | |
| 4,164,832 | A | | 8/1979 | Van Zandt | |
| 4,169,688 | A | | 10/1979 | Toshio | |
| 4,242,390 | A | | 12/1980 | Nemeth | |
| 4,243,716 | A | | 1/1981 | Kosaka et al. | |
| 4,245,689 | A | | 1/1981 | Grard et al. | |
| 4,246,310 | A | | 1/1981 | Hunt et al. | |
| 4,290,248 | A | | 9/1981 | Kemerer et al. | |
| 4,299,070 | A | | 11/1981 | Oltmanns et al. | |
| 4,426,820 | A | | 1/1984 | Terbrack et al. | |
| 4,431,044 | A | | 2/1984 | Bruneau | |
| 4,471,012 | A | | 9/1984 | Maxwell | |
| 4,501,102 | A | | 2/1985 | Knowles | |
| 4,561,233 | A | | 12/1985 | Harter et al. | |
| 4,585,685 | A | | 4/1986 | Forry et al. | |
| 4,612,745 | A | | 9/1986 | Hovde | |
| 4,641,469 | A | | 2/1987 | Wood | |
| 4,653,242 | A | | 3/1987 | Ezard | |
| 4,654,244 | A | | 3/1987 | Eckert et al. | |
| 4,703,597 | A | | 11/1987 | Eggemar | |
| 4,715,162 | A | | 12/1987 | Brightwell | |
| 4,738,071 | A | | 4/1988 | Ezard | |
| 4,752,497 | A | | 6/1988 | McConkey et al. | |
| 4,769,963 | A | | 9/1988 | Meyerson | |
| 4,819,932 | A | | 4/1989 | Trotter, Jr. | |
| 4,831,806 | A | | 5/1989 | Niese et al. | |
| 4,845,907 | A | | 7/1989 | Meek | |
| 4,905,442 | A | | 3/1990 | Daniels | |
| 4,947,602 | A | | 8/1990 | Pollasky | |
| 5,029,425 | A | | 7/1991 | Bogataj | |
| 5,103,614 | A | | 4/1992 | Kawaguchi et al. | |
| 5,113,632 | A | | 5/1992 | Hanson | |
| 5,117,603 | A | | 6/1992 | Weintraub | |
| 5,136,823 | A | | 8/1992 | Pellegrino | |
| 5,165,816 | A | | 11/1992 | Parasin | |
| 5,179,812 | A | | 1/1993 | Hill | |
| 5,205,091 | A | | 4/1993 | Brown | |
| 5,216,861 | A | | 6/1993 | Meyerson | |
| 5,251,996 | A | | 10/1993 | Hiller et al. | |
| 5,253,464 | A | | 10/1993 | Nilsen | |
| 5,283,102 | A | | 2/1994 | Sweet et al. | |
| 5,295,341 | A | | 3/1994 | Kajiwara | |
| 5,335,473 | A | | 8/1994 | Chase | |
| 5,348,778 | A | | 9/1994 | Knipp et al. | |
| 5,349,796 | A | | 9/1994 | Meyerson | |
| 5,390,457 | A | | 2/1995 | Sjölander | |
| 5,413,834 | A | | 5/1995 | Hunter et al. | |
| 5,433,806 | A | | 7/1995 | Pasquali et al. | |
| 5,474,831 | A | | 12/1995 | Nystrom | |
| 5,497,589 | A | | 3/1996 | Porter | |
| 5,502,939 | A | | 4/1996 | Zadok et al. | |
| 5,540,025 | A | | 7/1996 | Takehara et al. | |
| 5,567,497 | A | | 10/1996 | Zegler et al. | |
| 5,570,554 | A | * | 11/1996 | Searer | 52/539 |
| 5,597,024 | A | | 1/1997 | Bolyard et al. | |
| 5,630,304 | A | | 5/1997 | Austin | |
| 5,653,099 | A | | 8/1997 | MacKenzie | |
| 5,671,575 | A | | 9/1997 | Wu | |
| 5,694,734 | A | | 12/1997 | Cercone et al. | |
| 5,706,621 | A | | 1/1998 | Pervan | |
| 5,736,227 | A | | 4/1998 | Sweet et al. | |
| 5,768,850 | A | | 6/1998 | Chen | |
| 5,797,175 | A | | 8/1998 | Schneider | |
| 5,797,237 | A | | 8/1998 | Finkell, Jr. | |
| 5,823,240 | A | | 10/1998 | Bolyard et al. | |
| 5,827,592 | A | | 10/1998 | Van Gulik et al. | |

5,860,267 A 1/1999 Pervan
5,935,668 A 8/1999 Smith
5,943,239 A 8/1999 Shamblin et al.
5,953,878 A 9/1999 Johnson
5,968,625 A 10/1999 Hudson
5,985,397 A 11/1999 Witt et al.
5,987,839 A 11/1999 Hamar et al.
6,006,486 A 12/1999 Moriau et al.
6,023,907 A 2/2000 Pervan
6,065,262 A 5/2000 Motta
6,094,882 A 8/2000 Pervan
6,101,778 A 8/2000 Martensson
6,119,423 A 9/2000 Costantino
6,134,854 A 10/2000 Stanchfield
6,148,884 A 11/2000 Bolyard et al.
6,168,866 B1 1/2001 Clark
6,182,410 B1 2/2001 Pervan
6,186,703 B1 2/2001 Shaw
6,205,639 B1 3/2001 Pervan
6,209,278 B1 4/2001 Tychsen
6,216,403 B1 4/2001 Belbeoc'h
6,216,409 B1 4/2001 Roy et al.
D442,296 S 5/2001 Külik
D442,297 S 5/2001 Külik
D442,298 S 5/2001 Külik
D442,706 S 5/2001 Külik
D442,707 S 5/2001 Külik
6,224,698 B1 5/2001 Endo
6,238,798 B1 5/2001 Kang et al.
6,247,285 B1 6/2001 Moebus
D449,119 S 10/2001 Külik
D449,391 S 10/2001 Külik
D449,392 S 10/2001 Külik
6,324,803 B1 12/2001 Pervan
6,345,481 B1 2/2002 Nelson
6,363,677 B1 4/2002 Chen et al.
6,397,547 B1 6/2002 Martensson
6,418,683 B1 7/2002 Martensson et al.
6,421,970 B1 7/2002 Martensson et al.
6,427,408 B1 8/2002 Krieger
6,436,159 B1 8/2002 Safta et al.
6,438,919 B1 8/2002 Knauseder
6,446,405 B1 9/2002 Pervan
6,449,913 B1 9/2002 Shelton
6,449,918 B1 9/2002 Nelson
6,453,632 B1 9/2002 Huang
6,458,232 B1 10/2002 Valentinsson
6,460,306 B1 10/2002 Nelson
6,461,636 B1 10/2002 Arth et al.
6,465,046 B1 10/2002 Hansson et al.
6,490,836 B1 12/2002 Moriau et al.
6,497,961 B2 12/2002 Kang et al.
6,510,665 B2 1/2003 Pervan
6,516,579 B1 2/2003 Pervan
6,517,935 B1 2/2003 Kornfalt et al.
6,519,912 B1 2/2003 Eckmann et al.
6,521,314 B2 2/2003 Tychsen
6,532,709 B2 3/2003 Pervan
6,533,855 B1 3/2003 Gaynor et al.
6,536,178 B1 3/2003 Pålsson et al.
6,546,691 B2 4/2003 Leopolder
6,553,724 B1 4/2003 Bigler
6,558,754 B1 5/2003 Velin et al.
6,565,919 B1 5/2003 Hansson et al.
6,569,272 B2 5/2003 Tychsen
6,588,166 B2 7/2003 Martensson et al.
6,591,568 B1 * 7/2003 Pålsson ..... 52/592.2
6,601,359 B2 8/2003 Olofsson
6,606,834 B2 8/2003 Martensson et al.
6,617,009 B1 * 9/2003 Chen et al. ..... 428/195.1
6,635,174 B1 10/2003 Berg et al.
6,641,629 B2 11/2003 Safta et al.
6,646,088 B2 11/2003 Fan et al.
6,647,690 B1 11/2003 Martensson
6,649,687 B1 11/2003 Gheewala et al.
6,659,097 B1 12/2003 Houston
6,672,030 B2 1/2004 Schulte
6,675,545 B2 1/2004 Chen et al.
6,681,820 B2 1/2004 Olofsson
6,682,254 B1 1/2004 Olofsson et al.
6,685,993 B1 2/2004 Hansson et al.
6,711,864 B2 3/2004 Erwin
6,711,869 B2 3/2004 Tychsen
6,715,253 B2 4/2004 Pervan
6,723,438 B2 4/2004 Chang et al.
6,729,091 B1 5/2004 Martensson
6,745,534 B2 6/2004 Kornfalt
6,761,008 B2 7/2004 Chen et al.
6,761,794 B2 7/2004 Mott et al.
6,763,643 B1 7/2004 Martensson
6,766,622 B1 7/2004 Thiers
6,769,217 B2 8/2004 Nelson
6,769,218 B2 8/2004 Pervan
6,769,835 B2 8/2004 Stridsman
6,772,568 B2 8/2004 Thiers et al.
6,786,019 B2 9/2004 Thiers
6,803,109 B2 10/2004 Qiu et al.
6,805,951 B2 10/2004 Kornfält et al.
6,823,638 B2 11/2004 Stanchfield
6,841,023 B2 1/2005 Mott
6,907,702 B2 * 6/2005 Gilbert et al. ..... 52/555
7,137,229 B2 * 11/2006 Pervan ..... 52/313
2001/0029720 A1 10/2001 Pervan
2001/0034992 A1 11/2001 Pletzer et al.
2002/0007608 A1 1/2002 Pervan
2002/0007609 A1 1/2002 Pervan
2002/0014047 A1 * 2/2002 Thiers ..... 52/313
2002/0020127 A1 2/2002 Thiers et al.
2002/0046528 A1 4/2002 Pervan et al.
2002/0056245 A1 5/2002 Thiers
2002/0106439 A1 8/2002 Cappelle
2002/0160680 A1 10/2002 Laurence et al.
2003/0024200 A1 2/2003 Moriau et al.
2003/0024201 A1 2/2003 Moriau et al.
2003/0029115 A1 2/2003 Moriau et al.
2003/0029116 A1 2/2003 Moriau et al.
2003/0029117 A1 2/2003 Moriau et al.
2003/0033777 A1 2/2003 Thiers et al.
2003/0033784 A1 2/2003 Pervan
2003/0115812 A1 6/2003 Pervan
2003/0115821 A1 6/2003 Pervan
2003/0159385 A1 8/2003 Thiers
2003/0167717 A1 9/2003 Garcia
2003/0196405 A1 10/2003 Pervan
2003/0205013 A1 11/2003 Garcia
2003/0233809 A1 12/2003 Pervan
2004/0009320 A1 * 1/2004 Garcia ..... 428/44
2004/0016196 A1 1/2004 Pervan
2004/0035078 A1 * 2/2004 Pervan ..... 52/589.1
2004/0092006 A1 5/2004 Lindekens et al.
2004/0105994 A1 6/2004 Lu et al.
2004/0139678 A1 7/2004 Pervan
2004/0159066 A1 8/2004 Thiers et al.
2004/0177584 A1 9/2004 Pervan
2004/0191547 A1 * 9/2004 Oldorff ..... 428/479.3
2004/0200165 A1 10/2004 Garcia et al.
2004/0206036 A1 10/2004 Pervan
2004/0237447 A1 12/2004 Thiers et al.
2004/0237448 A1 12/2004 Thiers et al.
2004/0241374 A1 12/2004 Thiers et al.
2004/0244322 A1 12/2004 Thiers et al.
2004/0250493 A1 12/2004 Thiers et al.
2004/0255541 A1 * 12/2004 Thiers et al. ..... 52/578
2004/0258907 A1 12/2004 Kornfalt et al.
2005/0003149 A1 1/2005 Kornfalt et al.
2005/0016099 A1 1/2005 Thiers

| | | | | |
|---|---|---|---|---|
| 2005/0025934 | A1 | 2/2005 | Thiers | |
| 2005/0076598 | A1* | 4/2005 | Lewark | 52/591.4 |
| 2007/0059492 | A1* | 3/2007 | Oldorff | 428/151 |
| 2009/0159156 | A1* | 6/2009 | Walker | 144/363 |
| 2009/0178359 | A1* | 7/2009 | Garcia | 52/588.1 |

FOREIGN PATENT DOCUMENTS

| | | |
|---|---|---|
| AU | 713628 | 5/1998 |
| AU | 200020703 | 1/2000 |
| BE | 417526 | 9/1936 |
| BE | 557844 | 6/1957 |
| BE | 557844 | 3/1960 |
| BE | 09600527 | 6/1998 |
| BE | 09700344 | 10/1998 |
| CA | 991373 | 6/1976 |
| CA | 2226286 | 12/1997 |
| CA | 2252791 | 5/1999 |
| CA | 2289309 | 7/2000 |
| CH | 200949 | 1/1939 |
| CH | 211877 | 1/1941 |
| CH | 562377 | 5/1975 |
| DE | 314207 | 9/1919 |
| DE | 531989 | 8/1931 |
| DE | 740235 | 10/1943 |
| DE | 1089966 | 9/1960 |
| DE | 1534278 | 2/1966 |
| DE | 1212225 | 3/1966 |
| DE | 1212275 | 3/1966 |
| DE | 1534802 | 4/1970 |
| DE | 7102476 | 6/1971 |
| DE | 2007129 | 9/1971 |
| DE | 1534278 | 11/1971 |
| DE | 2252643 | 10/1972 |
| DE | 2238660 | 2/1974 |
| DE | 7402354 | 5/1974 |
| DE | 2502992 | 7/1976 |
| DE | 2616077 | 10/1977 |
| DE | 2917025 | 11/1980 |
| DE | 7911924 | 3/1981 |
| DE | 7928703 | 5/1981 |
| DE | 3041781 | 6/1982 |
| DE | 3214207 | 11/1982 |
| DE | 8226153 | 1/1983 |
| DE | 3343601 | 6/1985 |
| DE | 86040049 | 6/1986 |
| DE | 3512204 | 10/1986 |
| DE | 3246376 | 2/1987 |
| DE | 4004891 | 9/1990 |
| DE | 4002547 | 8/1991 |
| DE | 4134452 | 4/1993 |
| DE | 4215273 | 11/1993 |
| DE | 4242530 | 6/1994 |
| DE | 4011656 | 1/1995 |
| DE | 4324137 | 1/1995 |
| DE | 4107151 | 2/1995 |
| DE | 29517128 | 2/1996 |
| DE | 4242530 | 9/1996 |
| DE | 3544845 | 12/1996 |
| DE | 29710175 | 9/1997 |
| DE | 19616510 | 3/1998 |
| DE | 19651149 | 6/1998 |
| DE | 19709641 | 9/1998 |
| DE | 19718319 | 11/1998 |
| DE | 19735189 | 6/2000 |
| DE | 20001225 | 8/2000 |
| DE | 19925248 | 12/2000 |
| DE | 20017461 | 3/2001 |
| DE | 20018284 | 3/2001 |
| DE | 10124081 | 6/2002 |
| DE | 20206460 | 8/2002 |
| DE | 203 11 568 | 10/2003 |
| DE | 20315676 | 1/2004 |
| DE | 20218331 | 5/2004 |
| DE | 102 56 501 | 7/2004 |
| EP | 0248127 | 12/1987 |
| EP | 0623724 | 11/1994 |
| EP | 0652340 | 5/1995 |
| EP | 0667936 | 8/1995 |
| EP | 0690185 | 1/1996 |
| EP | 0849416 | 6/1998 |
| EP | 0698162 | 9/1998 |
| EP | 0903451 | 3/1999 |
| EP | 0855482 | 12/1999 |
| EP | 0877130 | 1/2000 |
| EP | 0969163 | 1/2000 |
| EP | 0969164 | 1/2000 |
| EP | 0974713 | 1/2000 |
| EP | 0843763 | 10/2000 |
| EP | 1200690 | 5/2002 |
| EP | 0958441 | 7/2003 |
| EP | 1026341 | 8/2003 |
| ES | 163421 | 9/1968 |
| ES | 460194 | 5/1978 |
| ES | 283331 | 5/1985 |
| ES | 1019585 | 12/1991 |
| ES | 1019585 | 1/1992 |
| ES | 2168045 | 5/2002 |
| FI | 843060 | 8/1984 |
| FR | 1293043 | 4/1962 |
| FR | 2691491 | 11/1983 |
| FR | 2568295 | 5/1986 |
| FR | 2623544 | 5/1989 |
| FR | 2630149 | 10/1989 |
| FR | 2637932 | 4/1990 |
| FR | 2675174 | 10/1991 |
| FR | 2667639 | 4/1992 |
| FR | 2691491 | 11/1993 |
| FR | 2697275 | 4/1994 |
| FR | 2712329 | 5/1995 |
| FR | 2776956 | 10/1999 |
| FR | 2781513 | 1/2000 |
| FR | 2785633 | 5/2000 |
| GB | 424057 | 2/1935 |
| GB | 585205 | 1/1947 |
| GB | 599793 | 3/1948 |
| GB | 636423 | 4/1950 |
| GB | 812671 | 4/1959 |
| GB | 1033866 | 6/1966 |
| GB | 1034117 | 6/1966 |
| GB | 1044846 | 10/1966 |
| GB | 1237744 | 6/1968 |
| GB | 1127915 | 9/1968 |
| GB | 1275511 | 5/1972 |
| GB | 1399402 | 7/1975 |
| GB | 1430423 | 3/1976 |
| GB | 2117813 | 10/1983 |
| GB | 2126106 | 3/1984 |
| GB | 2152063 | 7/1985 |
| GB | 2238660 | 6/1991 |
| GB | 2243381 | 10/1991 |
| GB | 2256023 | 11/1992 |
| JP | 54-65528 | 5/1979 |
| JP | 57-119056 | 7/1982 |
| JP | 59-186336 | 10/1984 |
| JP | 3-169967 | 7/1991 |
| JP | 4-106264 | 4/1992 |
| JP | 5-148984 | 6/1993 |
| JP | 6-56310 | 5/1994 |
| JP | 6-146553 | 5/1994 |
| JP | 6-200611 | 7/1994 |
| JP | 6-320510 | 11/1994 |
| JP | 7-76923 | 3/1995 |
| JP | 7-180333 | 7/1995 |
| JP | 7-300979 | 11/1995 |
| JP | 7-310426 | 11/1995 |

| | | |
|---|---|---|
| JP | 8-109734 | 4/1996 |
| JP | 8-270193 | 10/1996 |
| NE | 7601773 | 2/1976 |
| NO | 157871 | 2/1988 |
| NO | 305614 | 6/1999 |
| SE | 7114900-9 | 9/1974 |
| SE | 450411 | 6/1987 |
| SE | 450141 | 9/1987 |
| SE | 501014 | 10/1994 |
| SE | 501914 | 6/1995 |
| SE | 502994 | 4/1996 |
| SE | 506254 | 11/1997 |
| SE | 509059 | 11/1998 |
| SE | 509060 | 11/1998 |
| SE | 512290 | 2/2000 |
| SE | 512313 | 2/2000 |
| SE | 0000200-6 | 8/2001 |
| SU | 363795 | 12/1972 |
| WO | 84/02155 | 6/1984 |
| WO | 87/03839 | 7/1987 |
| WO | 89/08539 | 9/1989 |
| WO | 92/17657 | 10/1992 |
| WO | 93/13280 | 7/1993 |
| WO | 93/19910 | 10/1993 |
| WO | 94/01628 | 1/1994 |
| WO | 94/26999 | 11/1994 |
| WO | 95/06176 | 3/1995 |
| WO | 96/27719 | 9/1996 |
| WO | 96/27721 | 9/1996 |
| WO | 96/30177 | 10/1996 |
| WO | 97/47834 | 12/1997 |
| WO | 98/24495 | 6/1998 |
| WO | 98/24994 | 6/1998 |
| WO | 98/38401 | 9/1998 |
| WO | 99/40273 | 8/1999 |
| WO | 99/66151 | 12/1999 |
| WO | 99/66152 | 12/1999 |
| WO | 00/06854 | 2/2000 |
| WO | 00/66856 | 11/2000 |
| WO | 01/66876 | 9/2001 |
| WO | 2005/066431 | 7/2005 |

OTHER PUBLICATIONS

Opposition II EPO. 698. 162—Facts—Arguments Evidence (11 pages)—translation.

U.S. Court of Appeals for the Federal Circuit, 02-1222-1291 *Alloc, Inc.* vs. *International Trade Commission*, pp. 1-32.

U.S. Court of Appeals for the Federal Circuit Decision in *Alloc, Inc. et al.* vs. *International Trade Commission and Pergs, Inc. et al.* decided Sep. 10, 2003.

European Search Report for corresponding application EP 06 02 5386.

* cited by examiner

PANEL AND METHOD OF MANUFACTURE

CROSS-REFERENCE TO RELATED APPLICATIONS

The present application claims priority under 35 U.S.C. §119 of German Patent Application No. 10 2005 063 034.0, filed on Dec. 29, 2005, the disclosure of which is expressly incorporated by reference herein in its entirety.

BACKGROUND OF THE INVENTION

1. Field of the Invention

The invention relates to a panel, in particular a floor panel, with a core of a wooden material, in particular MDF or HDF, or a wooden material/plastic mixture and a pattern arranged on a visible side, whereby the visible side is provided on at least one side edge with a chamfer running at an angle $\alpha$.

2. Discussion of Background Information

In panels, the pattern is either printed directly on the top of the panel or applied to a paper web which, together with a synthetic resin layer, is pressed to the visible side of the board. The chamfer is produced by milling the side edge. Subsequently, a corresponding decorative strip is adhesively bonded to the chamfer or the pattern is printed on the visible side by transfer printing. In particular if the floor panel is made to look like wood, that is, the pattern is provided with a structure (differences in color) that corresponds to the grain of genuine wood, a relief is often embossed into the synthetic resin layer that covers the decorative layer. The relief is designed to underscore the genuine wood character by way of the resulting indentations or elevations.

Compared to genuine wood panels, the laminate panels have the advantage that they are harder, more loadable, easier to handle, easier to care for, have greater variation and are more versatile. In order to increase consumer acceptance, though, attempts have been made to adapt the appearance and feel of the panel to a genuine wood panel as naturally as possible. For example, a V-groove is formed between two panels connected to one another through the chamfer milled on the side edges. These grooves reflect the look of a joint true to the original.

SUMMARY OF THE INVENTION

The invention is directed to the development of the known panel such that the area covered with the panels approximates more closely in look and feel one of natural materials (e.g., genuine wood, terracotta, stone). To attain such features, the generic panel is provided with an angle $\alpha$ of at least one chamfer which varies over the length.

Through this embodiment, a chamfer of irregular width is produced which forms a V joint with panels connected to one another. The joint through the irregular upper edge simulates an aged structure such as occurs through signs of wear on panels of natural materials after years of use.

It is advantageous if the chamfers are also provided with a pattern.

A relief is preferably embossed into the surface of the chamfers so that the look and feel of the joint are adapted to the top of the board.

The pattern is preferably printed directly onto the visible side of the board and/or the chamfer. By doing this, the decorative paper or the carrier layer necessary for the transfer print is omitted, which reduces production costs. Moreover, an embodiment of this kind means that the application of a synthetic resin layer first can be omitted.

In the case of conventional panels, corundum particles are inserted in the synthetic resin layer, which is generally a paper impregnated with melamine resin, in order to increase the abrasion resistance. These corundum particles lead to a high level of tool wear. Through the printing of the decoration directly onto the board, a melamine resin can be applied in liquid form or sprayed or rolled, optionally in several layers, onto the top of the board including the chamfer, and after hardening the relief is embossed.

A method for producing the panel with the differing chamfer angle is also provided. The method includes the side edge of the panel being guided past an oscillating machining tool. The machining tool preferably oscillates about an axis running parallel to the transport direction of the panel.

If a laser is used as a machining tool, the machining is carried out in a wear-free manner. Moreover, it is also advantageous that the control of a laser cutter is simple and no cutting forces act on the panel.

In further embodiments, a panel comprises a core of a wooden material, and a pattern arranged on a visible side thereof. The visible side is provided on at least one side edge (I, II) with a chamfer running at an angle with a length (L) of the chamfer. The angle varies over the length (L).

In further embodiments, the chamfer includes a pattern. A relief is embossed in a surface of the chamfer. The pattern on the chamfer is covered with a synthetic resin layer and the relief is embossed in the synthetic resin layer. The pattern is printed directly onto at least one of the visible side and the chamfer. The pattern has a structure. The relief embossed in a surface of the chamfer and corresponds to the structure. Two opposite side edges (I, II) include the chamfer. All side edges of the panel include the chamfer. The core is one of MDF, HDF, and wooden material/plastic mixture. The structure is a wood grain. The panel comprises a tongue and groove having a locking mechanism configured to lock joined panels in a horizontal direction. The chamfer is flat or curved in a convex or concave manner. A size of the angle changes arbitrarily over the length (L) of the chamfer. The angle varies in a range of 15°-89°. The angle varies between 37° and 42°. A lower edge of the chamfer runs straight, based on the visible side, such that an impermeable connection of two panels is provided.

In still further embodiments, a method for producing a panel comprises guiding a side edge (I or II) of the panel past an oscillating machining tool to form a chamfer having angle which varies over a length. The machining tool oscillates about an axis running parallel to a transport direction (T) of the panel. The machining tool is a laser. The machining tool has a mass unbalance to generate the oscillation.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
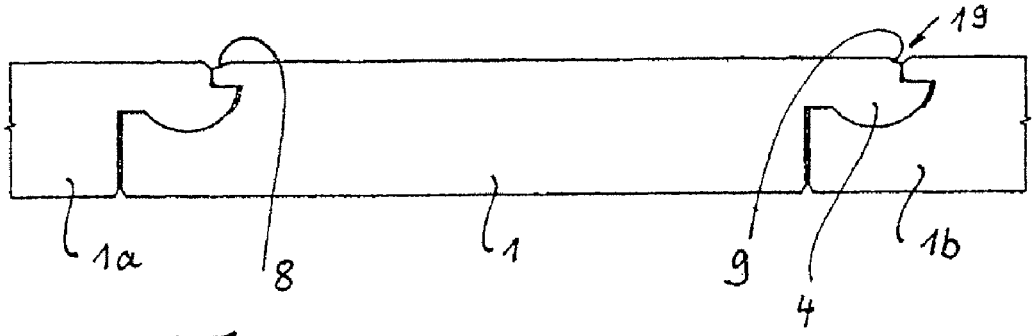
FIG. 1 shows a side view of three panels connected to one another in partial representation.
Figure 2:
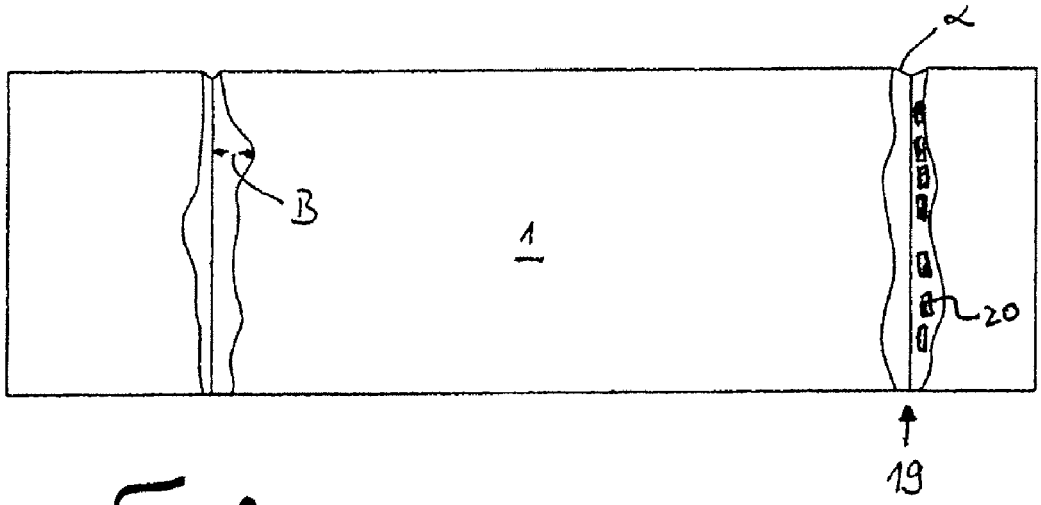
FIG. 2 shows a plan view of the panels according to FIG. 1.
Figure 3:
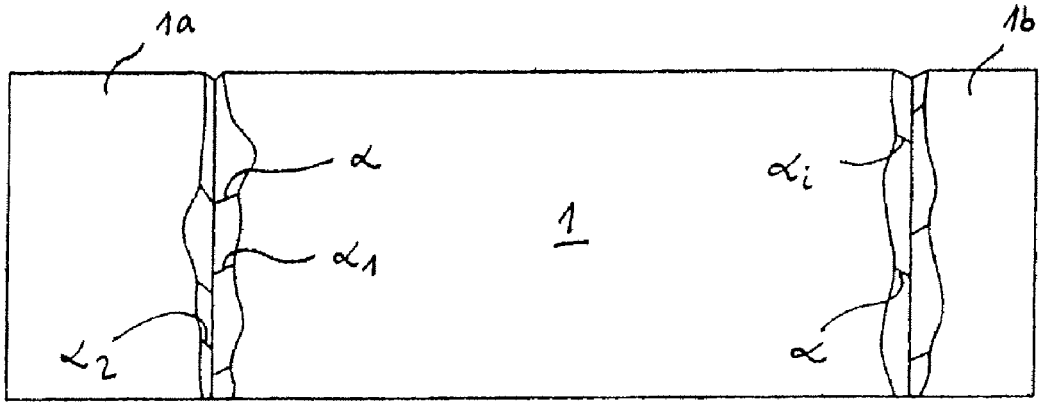
FIG. 3 shows a representation of FIG. 2 with different angles indicated.
Figure 4:
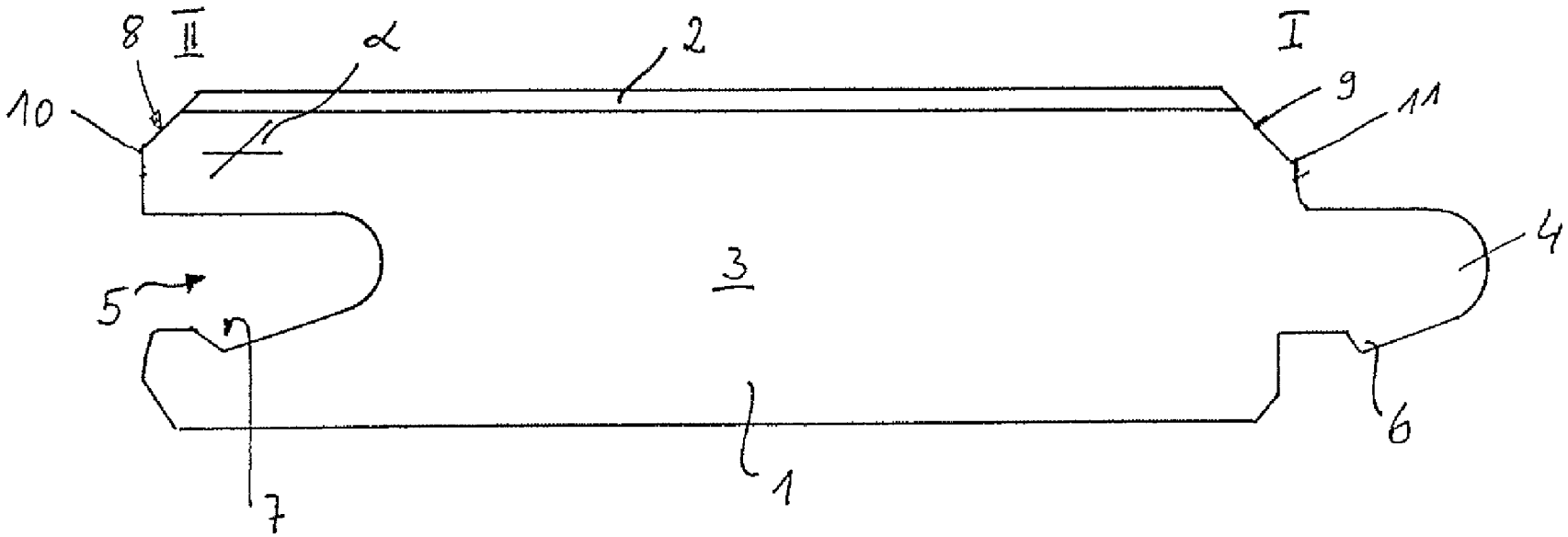
FIG. 4 shows an exemplary embodiment of a panel in side view.
Figure 5:
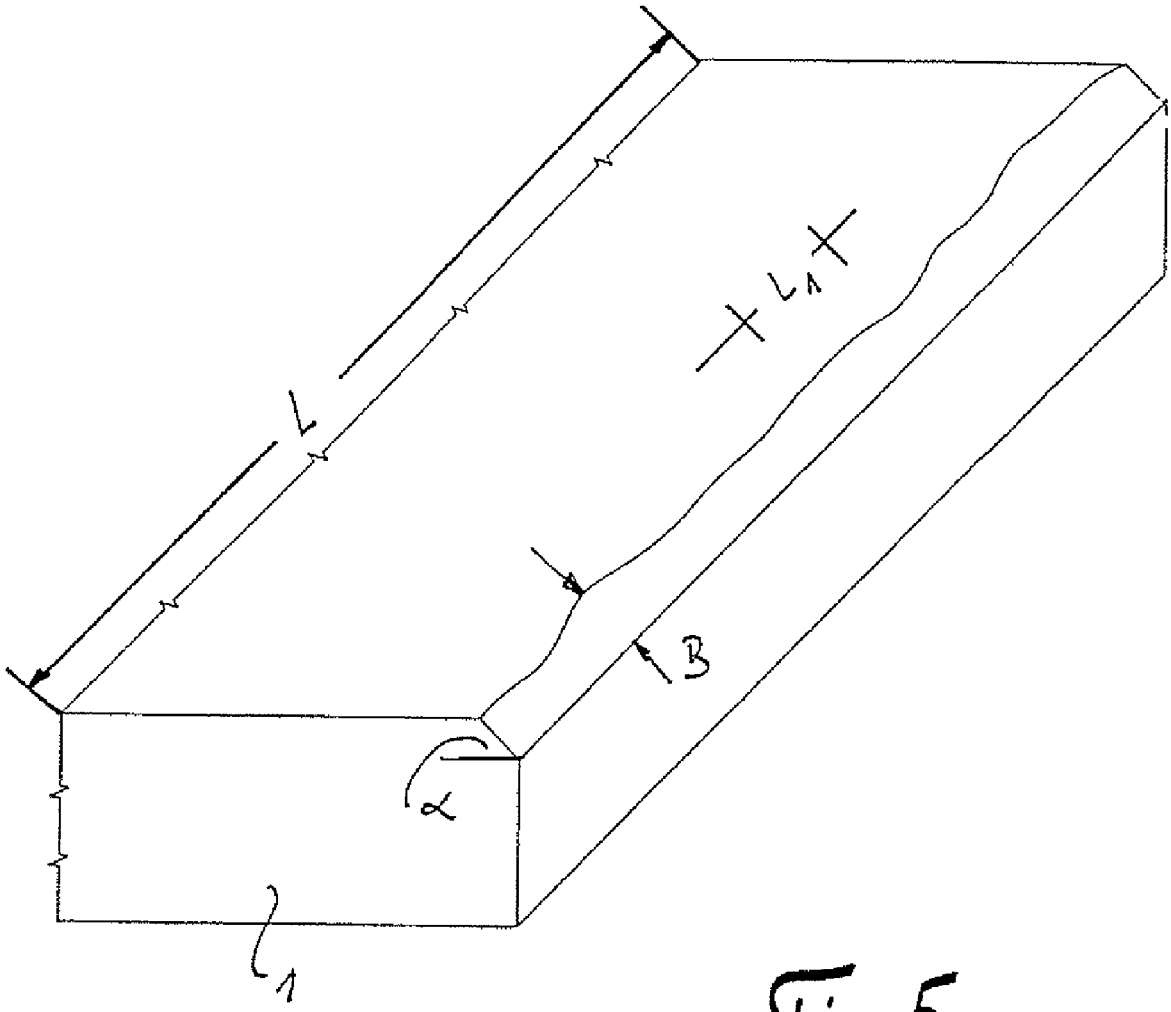
FIG. 5 shows a schematic representation of the chamfer on a panel in perspective representation.

Referring to FIGS. 1-6 and more specifically FIG. 4, the core 3 of the panel 1 comprises a wooden material, in particular MDF or HDF, a wooden material/plastic mixture or a pure plastic mixture. The visible side of the panel 1 is provided with a pattern 2. On the opposite side edges I, II, the panel 1 has a tongue 4 or a groove S corresponding thereto. The tongue 4 and groove 5 are provided with locking means 6, 7, via which two panels 1, 1*a* connected to one another can be locked to one another so that they can be laid without glue. Such panels are called click-in panels.

On the opposite side edges I, II, the panel 1 is provided with a chamfer 48, 9 that is embodied over the length L of the panel 1 at different angles $\alpha$, $\alpha_1$, $\alpha_i$ of less than 1° to 75°, e.g., see FIG. 3. The size of the angles $\alpha$, $\alpha_1$, $\alpha_2$ does not change continuously, but arbitrarily, whereby the size of the angles $\alpha$, $\alpha_1$, $\alpha_2$ changes over the length $L_1$ of the area of the chamfer 8, 9, which is determined iteratively in an area embodied at a constant angle $\alpha_1$, in order to obtain a V joint that is "worn" in the most natural looking manner possible. To this end, for example, the joint of a floor of genuine wood panels having the corresponding appearance of wear can be measured and the angles and lengths transferred accordingly.

As FIG. 2 shows, the width B of the chamfers 8, 9 or the width of the V joint 19 differs due to the changing angle $\alpha$, $\alpha_1$, $\alpha_2$ over the length L of the panel 1, 1*a*, 1*b*. The chamfers 8, 9 can be embodied to be flat or curved in a convex or concave manner. The angles $\alpha$, $\alpha_1$, $\alpha_2$ vary in the range of 15°-89°. Visually attractive joints can be produced with angles $\alpha$ between 37° and 42° of the chamfers 8, 9. A relief 20 is embossed on the chamfers.

Referring again to FIG. 4, the lower edge 10, 11 of the chamfers 8, 9 runs straight, based on the visible side, to ensure that an impermeable connection of two panels 1*a*, 1*b*, 1*c* is guaranteed and no moisture can penetrate via the vertical joint. The chamfers 8, 9 are varnished or coated with a melamine resin. The pattern of the chamfer 8, 9 is adapted to the pattern 2 on the visible side.

A variety of chamfer geometries can be produced by means of a laser cutting head 13 attached to a CNC support 12. In such an embodiment, the cutting head is connected with a light guide to the beam source.

Figure 6:
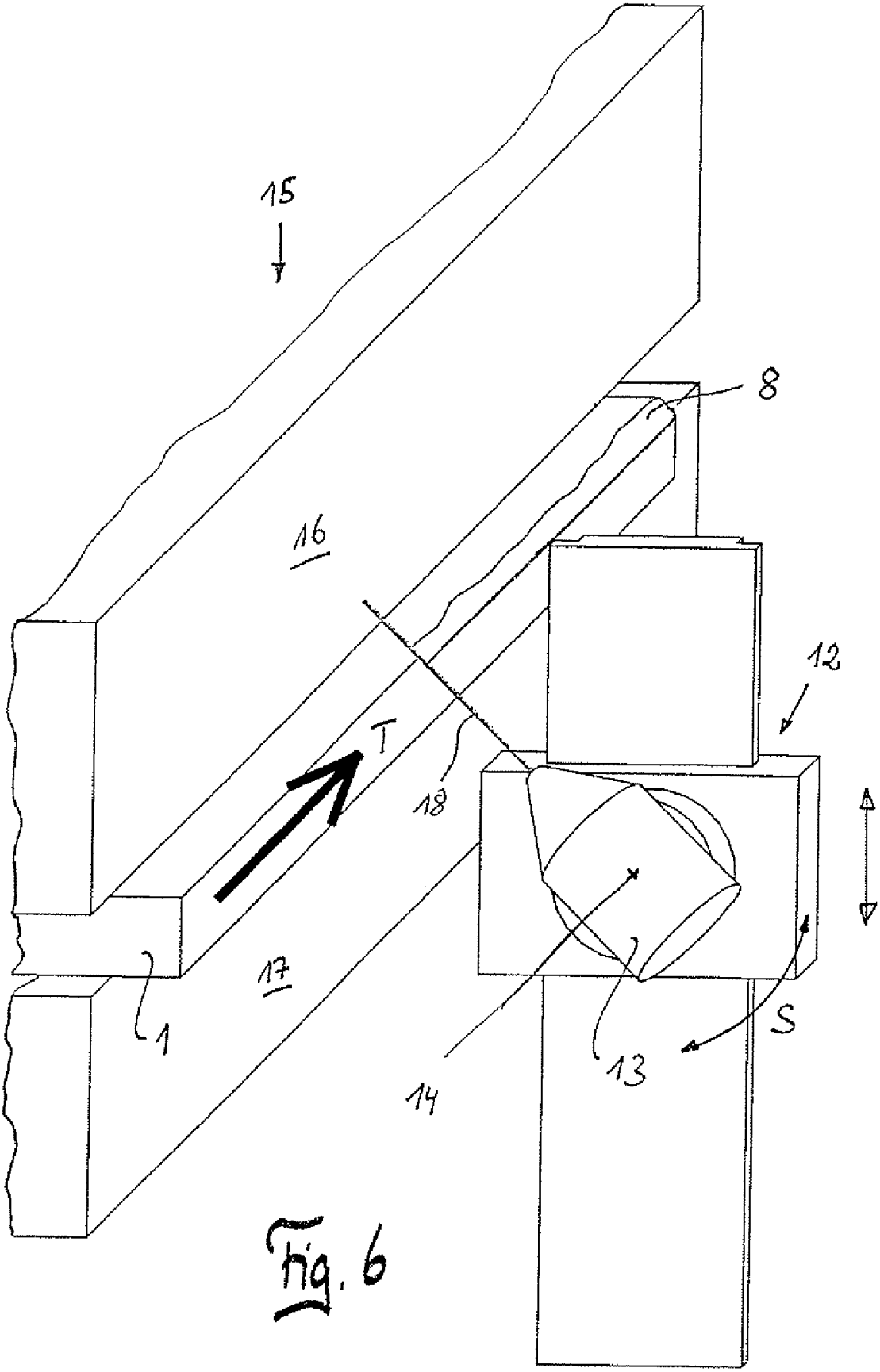
FIG. 6 shows a simplified sketch of a production step.

As FIG. 6 shows, the panel 1 to be machined is guided in a so-called double-end profiler 15 and transported in the transport direction T. The top and/or bottom of panel 1 comes into contact with a chain-like conveyor device (not shown in detail) which conveys the panel 1 along its direction of movement T. The panel 1 passes through different machining stations.

In the machining stations, the side edges of the panel 1 projecting out of the conveyor 15 are predominantly machined. For example, the tongue 4 and the groove 6 are milled.

In order to increase the precision during machining, the panel 1 is guided through between two metal plates 16, 17 and fixed by pressure shoes. Finally, the panel 1 is guided past the laser 13, which oscillates about the axis 14 running parallel to the transport direction T in the direction S. The CNC support 12 oscillates up and down depending on the laser oscillation S so that the lower edge 10, 11 of the chamfers 8, 9 remains constant. The frequency of the oscillation of the laser 13 is non-uniform but reproducible. The angle $\alpha$ is generated on the panel 1 depending on the angle of the laser 13 to the axis 14. The laser beam 18 vaporizes the material it hits and penetrates the panel 1. The residual beam hits a special beam trap and is destroyed there.

Naturally, conventional chip-removing machining tools (e.g., mills, planes) can be used instead of the laser 13. To produce the oscillating movement of the machining tool, it can also be provided with a mass unbalance.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

It is claimed:

1. A panel comprising a core of a wooden material, a pattern arranged on a visible side thereof, the visible side being provided on at least one side edge (I, II) with a chamfer running at an angle with a length (L) of the chamfer, the angle varying over the length (L) of at least one chamfer in a range of 15°-89° and a relief embossed in a surface of the chamfer, wherein all side edges of the panel include the chamfer and a lower edge of the chamfer runs straight, based on the visible side, such that an impermeable connection of two panels is provided.

2. The panel according to claim 1, wherein the chamfer includes a pattern.

3. The panel according to claim 2, wherein the pattern on the chamfer is covered with a synthetic resin layer and the relief is embossed in the synthetic resin layer.

4. The panel according to claim 2, wherein the pattern is printed directly onto at least one of the visible side and the chamfer.

5. The panel according to claim 2, wherein the pattern has a structure.

6. The panel according to claim 5, wherein the relief embossed in the surface of the chamfer corresponds to the structure.

7. The panel according to claim 1, wherein the core is one of MDF, HDF, and wooden material/plastic mixture.

8. The panel according to claim 5, wherein the structure is a wood grain.

9. The panel according to claim 1, wherein the panel comprises a tongue and groove having a locking mechanism configured to lock joined panels in a horizontal direction.

10. The panel according to claim 1, wherein a size of the angle changes arbitrarily over the length (L) of the chamfer.

11. The panel according to claim 1, wherein the chamfer is flat or curved in a convex or concave manner.

12. The panel according to claim 1, wherein the angle varies between 37° and 42°.

13. A panel comprising:

a core of a wooden material/plastic mixture, a pattern arranged on a visible side of the core, the visible side being provided on at least one side edge (I, II) with a chamfer running at an angle with a length (L) of the chamfer, the angle varying over the length (L) in a range of 15°-89°, and a lower edge of the chamfer runs straight, a relief embossed on a surface of the chamfer which corresponds to the pattern printed directly onto the visible side and the chamfer, wherein the pattern on the chamfer is covered with a synthetic resin layer and the relief is embossed in the synthetic resin layer.

14. A panel comprising:

an HDF or MDF core, a chamfer on at least one side edge (I, II) of the visible side, the chamfer running at an angle varying over a length (L) of the at least one side edge, wherein the chamfer runs straight at a lower edge, based on the visible side, such that an impermeable connection of two panels is provided, a pattern printed directly on a visible side of the core and the chamfer such that the visible side is devoid of a decorative paper or carrier layer, a synthetic resin layer applied on the chamfer, and a relief embossed in the synthetic resin layer surface of the chamfer which corresponds to the pattern printed directly onto the visible side and the chamfer.

15. The panel according to claim 13, wherein the chamfer is flat or curved in a convex or concave manner and the lower edge of the chamfer runs straight, based on the visible side, such that an impermeable connection of two panels is provided.

* * * * *